United States Patent [19]

Mural

[11] Patent Number: 5,064,100

[45] Date of Patent: Nov. 12, 1991

[54] DEVICE FOR CREATING FLUID GRADIENTS

[76] Inventor: Andrew Mural, 1038-J Provence Dr., St. Louis, Mo. 63125

[21] Appl. No.: 497,433

[22] Filed: Mar. 22, 1990

[51] Int. Cl.[5] ..... B67D 5/60

[52] U.S. Cl. ..... 222/143; 222/145; 222/181; 215/10; 220/23.4

[58] Field of Search ..... 111/143, 145, 181, 184, 111/185; 220/23.4; 215/10; 206/504

[56] References Cited

U.S. PATENT DOCUMENTS

| | | | |
|---|---|---|---|
| 59,333 | 10/1866 | Bullard | 215/10 |
| 3,412,902 | 11/1968 | Milner et al. | 222/145 |
| 3,933,268 | 1/1976 | Buske | 215/10 |
| 3,955,715 | 3/1976 | Topor | 222/143 |
| 4,143,795 | 3/1979 | Casebier | 222/185 |
| 4,512,764 | 4/1985 | Wunsch | 222/145 |
| 4,674,658 | 6/1987 | Van Brocklin | 222/145 |
| 4,979,644 | 12/1990 | Meyer et al. | 222/145 |

OTHER PUBLICATIONS

N. Anderson and W. G. Anderson, "Analytical Techniques for Cell Fractions", 10/21/1977, see all pages.

*Primary Examiner*—Donald T. Hajec
*Assistant Examiner*—Shari Wunsch
*Attorney, Agent, or Firm*—Haverstock, Garratt and Roberts

[57] ABSTRACT

A system for creating liquid gradients is disclosed, comprising at least two containers that can be manufactured separately, such as by molding plastic. Each container has an outlet near the bottom and an air vent near the top, and the outlets are connected via tubing to a receiving device in which the liquids are mixed. One container has a horizontal cross-section which decreases as a function of vertical position between the top and bottom of the container; the other container has a horizontal cross-section which increases vertically in a complementary manner. The containers preferably are held together by a rack or other means. As the liquids drain from both containers simultaneously, they remain in hydrostatic balance with each other. Since their fluid levels drop at the same rate, the ratio of liquids entering the mixing device will vary in a controlled, desired manner that depends on the shapes of the containers, according to the ratio of the horizontal surfaces areas of the liquids in their containers at any moment. This creates a desired gradient in the receiving device. By using inexpensive, mass-manufactured, disposable plastic containers, this system provides for simple, inexpensive, rapid creation of gradients which are sufficiently precise and reproducible for work such as chromatography, isoelectric focusing, or other types of separation of biological mixtures in a laboratory, using fluid-handling components that do not need to be cleaned or sterilized.

18 Claims, 3 Drawing Sheets

DEVICE FOR CREATING FLUID GRADIENTS

FIELD OF THE INVENTION

This invention is in the field of liquid mixing devices and flow-control devices. It also relates to the creation of gradients used to separate chemical mixtures in processes such as electrophoresis, isoelectric focusing, and chromatography.

BACKGROUND OF THE INVENTION

In the preparation of devices which can be used for processes such as electrophoresis, isoelectric focusing (IEF), and chromatography, it is often necessary to create liquid gradients. Such gradients can subsequently be immobilized (e.g., by a polymerization reaction which converts the liquid into a gel, or by using a liquid to coat a solid surface and then fully or partially drying the coated surface). Alternately, liquid gradients can be convection-stabilized (e.g., by adding the liquid gradient to a tube, trough, or other vessel which contains particulate matter or capillary tubes); such stabilized gradients will remain useful for a substantial period of time even though the compound forming the gradient remains liquid. As a third option, liquid gradients can be injected into or otherwise added to a container, conduit, or flow stream in a time-dependent manner, such as during various types of chromatography.

By controlling the starting compounds, liquid or gel gradients can involve various differing characteristics, such as varying concentration, varying density, varying acidity (usually expressed as pH), or varying molecular size. Such gradients are useful in many chemical and biological procedures, on scales ranging from analysis of sub-microgram quantities, to industrial production involving kilograms or metric tons.

As used herein, the term "liquid gradient" refers to a liquid output from a device, where the liquid output undergoes a transition from one state or condition (such as salt concentration, pH, density, molecular weight, etc.) to a different state or condition, where the transition is a predetermined, reproducible, and desirable function of time, volume, or some other variable. Liquid gradients can, in some cases, involve abrupt or steep transitions (which occur at "boundaries" or "interfaces" between different conditions or zones); they can also involve flat plateaus, or steep transitions. For example, a gradient with a steep or abrupt transition can be created by (1) partially filling a tube with a polymerizable compound, (2) halting the flow of liquid to the tube while the concentration of one or more substances in the liquid is substantially increased or decreased, (3) adding more liquid to the tube, and (4) polymerizing the liquid in the tube. That will create two zones of gel with an abrupt or steep boundary between them. If desired, either zone can have its own gradient.

In the prior art, liquid gradients used for electrophoresis, IEF, chromatography, etc., have been produced by several different means, none of which are wholly satisfactory.

One such means involves the delivery of liquid components from two or more separate vessels into a mixing chamber, using two or more pumps. One pump is controlled to provide an increasing flow rate of Liquid A, while the other pump provides a decreasing flow rate of Liquid B, so the total flow rate from both pumps remains constant or nearly constant. The flow rates can be adjusted in any way desired, to create linear, convex, or concave gradients.

That system has several shortcomings. It is complex and expensive; at least two variable-speed, accurately calibrated pumps and a control system are required, and the system must be run by a computer such as an Apple or an IBM-PC (which ties up the computer while the gradient is being formed). One such system, sold by Bodman Chemicals (Aston, PA) cost roughly two thousand dollars in March 1989, not including the computer. In addition, the use of pumps creates several potential problems. Pumps can become clogged (which is often difficult to detect promptly), they can cause fluctuations in flow rates which are also difficult to detect and correct, and most types of pumps except peristaltic pumps usually must be cleaned between uses, especially if different liquids are involved.

Another method of producing liquid gradients involves a mixing vessel which initially contains Liquid A, and a connected reservoir which contains Liquid B. The mixing vessel usually contains a stirring device. As liquid is removed from the mixing vessel and pumped to the device that will contain or process the gradient, it initially contains Liquid A only. As Liquid B is transferred from the reservoir to the mixing vessel, the resulting mixture will contain increasing concentrations of Liquid B.

These systems are sold in various configurations. For example, devices containing concentric cylinders (with a stirring device in the interior cylinder) are sold by Kontes Life Sciences Products (Vineland, NJ), Isolab Inc. (Akron, OH), Bethesda Research Labs (Gaithersburg, MD), and Whatman Lab Sales (Hillsboro, OR). "Dual piston" systems containing side-by-side cylinders (one of which contains a stirring device) are sold by Jule, Inc. (New Haven, CT), Cole-Parmer Instrument Co. (Chicago, IL), and Whatman Lab Sales.

There are various shortcomings to these dual reservoir systems. A stirring device normally must be used at high speed to ensure prompt and thorough mixing in the mixing chamber; however, this can cause splashing and fluid loss, and the vortex and turbulence can create abnormalities in the gradient. Two pumps are often required to run the system, and fluctuations or differences in the flow rates from those pumps can introduce variability in the gradient. Differences in the viscosity of the liquids can also introduce variability in the gradient. Those factors can make it very difficult to reproduce precisely equivalent gradients on different days, which is a serious drawback, since high levels of precision and reproducibility are often required for electrophoresis, IEF, or chromatography.

A third type of gradient maker is sold as the ID-300 Anderson-Dalt gradient maker by Hoefer Scientific Instruments (San Francisco, CA). This type of gradient maker, which is normally sold as part of a larger "Iso-Dalt" system used for two dimensional electrophoresis, is briefly described in N. G. Anderson and N. L. Anderson, *Analytical Biochemistry* 85: 341–543 (1978) at pages 344–345. Additional information is available in the 1988 ISO-DALT user's manual, available from Hoefer or from Large Scale Biology Corporation (Rockville, MD).

The Anderson-Dalt gradient maker involves a rectangular chamber made of clear acrylic. An internal barrier called a "septum," made of silicone rubber, divides the chamber into two compartments. By positioning the septum in an angled or curved configuration, it is possible to vary the sizes of the two compartments. For example, by placing the septum at an angle, Compartment A can have a large area and volume near the top of the rectangular chamber while Compartment B has a small area and volume; the relative sizes of the two compartments are reversed near the bottom of the chamber. Both compartments are drained, through tubes connected to an outlet at the bottom of each compartment, into a mixing device.

If compartment A is larger than compartment B at the top of the chamber, then a larger volume of liquid A than liquid B will enter the mixing device as the drainage process begins. This follows from two facts: (1) the two compartments establish and remain in hydrostatic equilibrium with each other (via the tubing) during the drainage process; therefore, (2) their fluid levels will remain roughly equal (dropping at the same rate) as both compartments are drained. At any moment, the ratio of the A:B mixture entering the mixing device will be equal to the ratio of the horizontal areas of their fluid surfaces. That ratio changes as the fluid level drops, due to the angle or curvature of the septum which divides the compartments. Since the positioning of the septum can be controlled, that ratio can be controlled, and the resulting mixture of A and B forms a controllable gradient.

That system also suffers from several disadvantages. It is expensive; in March 1989 the price of the gradient maker (excluding the rest of the Iso-Dalt system) was over a thousand dollars. It must be disassembled and cleaned before it can be used with different liquids. In some situations it may need to be autoclaved to ensure sterility, which can require substantial delays and can take up space, time, and energy in the autoclave unit. Furthermore, it can be difficult to reposition the septum, requiring various calculations to determine where the septum should be re-positioned and measurements to ensure that the resulting gradient is the one desired. That difficulty becomes even greater when curved rather than linear arrangements are desired. The chamber and septum are expensive to replace if broken or damaged, the pieces must be handled carefully, and the screws can be misplaced on a cluttered lab bench. The unit is relatively tall, and it is normally placed on an elevated base to generate enough hydrostatic pressure to deliver the liquids to the mixing device; both factors make it susceptible to being knocked over in a busy lab.

The object of this invention is to provide an improved system for creating liquid gradients. This system should be relatively inexpensive, and it minimizes or eliminates the need for pumps and computerized control units. It is also easy to assemble and use, resistant to breakage, and easily and quickly cleaned and converted between uses. Despite those conveniences, it is able to generate liquid gradients with a wide variety of profiles, in a precise and reproducible manner, with a minimum of calibration, calculation, or monitoring.

SUMMARY OF THE INVENTION

This invention involves a system for creating liquid gradients, which comprises at least two containers which can be manufactured separately, such as by molding plastic. One container has a horizontal cross-section which decreases as a function of vertical position between the top and the bottom of the container; the other container has a horizontal cross-section which increases vertically in a complementary manner. In one preferred embodiment, each container has three planar vertical walls, and a fourth non-vertical angled or curved wall which fits snugly against the non-vertical angled or curved wall of the paired container, so that both containers will fit snugly and securely against each other in a rectangular configuration when held together by a holding means such as a rack. Each container has an outlet near the bottom and an air vent near the top. The outlets are designed to be connected via tubing or other conduits to a receiving device in which liquid mixing takes place. As the liquids in the containers are drained simultaneously, they will remain in hydrostatic balance with each other, through the tubing or mixing device. Since their fluid levels will drop at the same rate, the ratio of the different liquids entering the mixing device at any moment will vary according to the ratio of the surface areas of the liquids in their containers at that moment, thereby creating a desired gradient in the receiving device.

This system provides a method of mass-manufacturing inexpensive containers with precise sizes, which will allow for (1) simple and easy yet precise operation of the system and (2) rapid conversion of the system from one use to another. The containers can be made of disposable plastic or other suitable material to eliminate the need for cleaning and autoclaving, and to reduce the chance of breakage.

This invention also relates to molds and methods which can be used to manufacture the specially configured containers of this invention.

BRIEF DESCRIPTION OF THE DRAWINGS

The previously mentioned objectives and advantages of the present invention will become apparent to those skilled in the art after considering the following detailed description in conjunction with the accompanying drawings, wherein.

DESCRIPTION OF THE PREFERRED EMBODIMENTS

Figure 1:
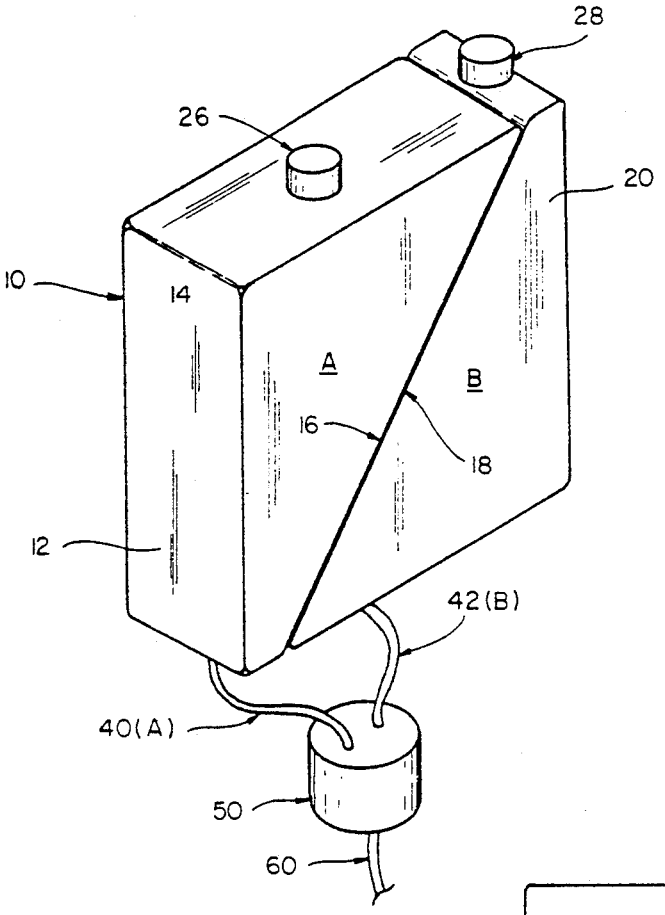
FIG. 1 is a perspective view of one embodiment of a gradient forming device in accordance this invention.

Referring to the drawings more particularly by reference numbers, number 10 in FIG. 1 refers to an assembly of containers shown in their assembled condition and constructed according to the teachings of the present invention. Assembly 10 includes two separate containers, designated as A and B.

As used herein, the term "separate containers" refers to containers which can be manufactured independently of each other, as distinguished from two compartments created by inserting a septum or other barrier into a chamber.

Container A has a peripheral wall formed by adjacent connected sidewall portions. Sidewall portions 12 and 14 are visible in FIG. 1; their vertical planar configuration provides the assembly with a rectangular configuration.

In container A, "mated wall" 16 is non-vertical. When the gradient forming system is assembled for use, mated wall 16 is placed in surface-to-surface contact with corresponding non-vertical mated wall 18 of container B. Container B also has an enclosed peripheral wall formed by adjacent connected sidewall sections, including sidewall portion 20 which is visible in FIG. 1.

Figure 2:
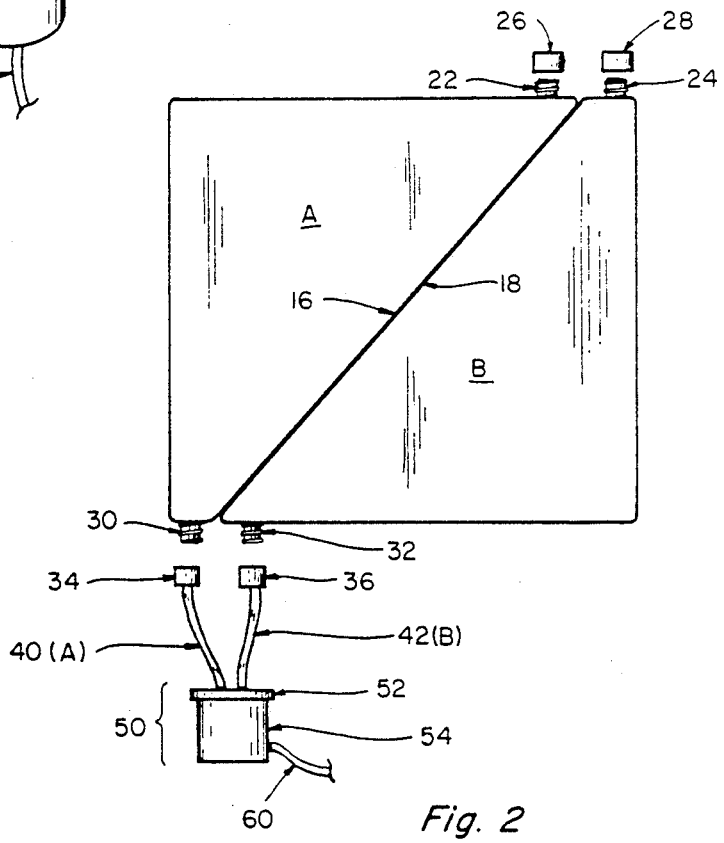
FIG. 2 is a side elevational view of the device, with the fittings disconnected.
Figure 4A:
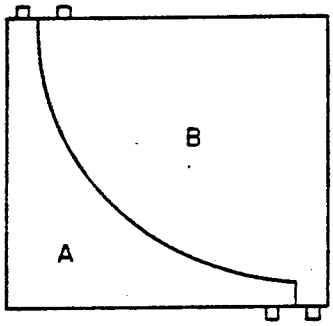
FIG. 4*a* is a side elevational view of a second embodiment of this invention, which will form a curved gradient.
Figure 5A:
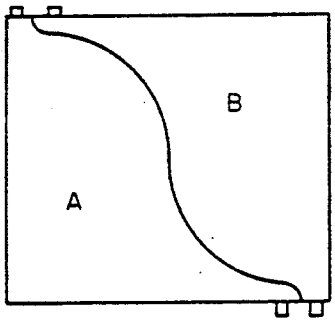
FIG. 5*a* is a side elevational view of a third embodiment of this invention, which will form a curved gradient.
Figure 6A:
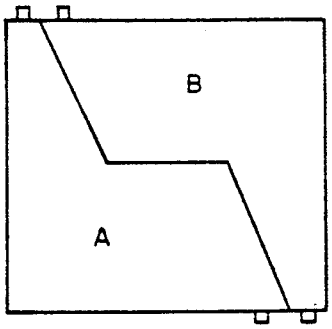
FIG. 6*a* is a side elevational view of a fourth embodiment of this invention, with complex mated walls.
Figure 6B:
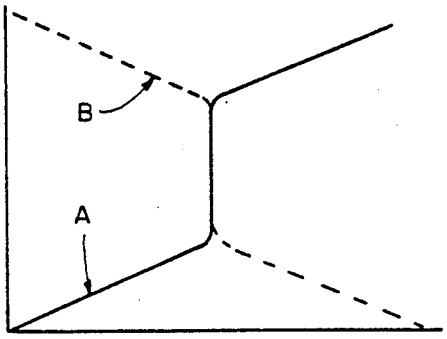
FIG. 6*b* is a graph depicting a gradient with steep transitions that will be formed by the containers shown in FIG. 6*a*.

The shape and orientation of mated walls 16 and 18 are important to the present invention because they affect the ratio at which the liquid contents of containers A and B are mixed as a function of time, as they drain or otherwise exit from the containers. The mated walls can have planar surfaces as shown in FIGS. 1 and 2, or they can have curved or contoured shapes as shown in FIGS. 4*a*, 5*a*, and 6*a*, depending upon the type of gradient desired.

The shape and orientation of the non-vertical mated walls affects the relationship and ratio between the surface areas of the liquids contained in containers A and B. When the containers A and B are relatively full, the area of the upper surface of the liquid in container A will be relatively large compared to the area of the upper surface of the liquid in container B. As the liquids are simultaneously drained from both containers, the surface area of the liquid in container A will decrease, while the surface area of the liquid in container B will increase. The A:B surface area ratio thereby undergoes a gradual and desirable change as the liquids are drained from both containers.

Figure 3:
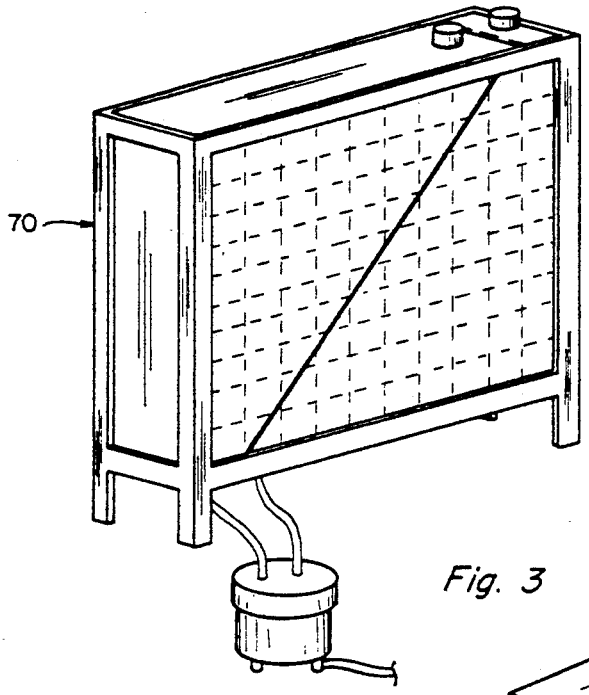
FIG. 3 is a perspective view of one embodiment of this invention, showing the containers held by a holding rack.

Since the vertical angle of mated walls 16 and 18 is the same, containers A and B can fit together snugly and securely within a holding means or device, such as rectangular rack 70 shown in FIG. 3, which can be made of plastic, metal, or other suitable material.

If desired, the containers of this invention can be designed to fit in a rack having an upright cylindrical configuration or any other desired shape, by using peripheral walls having a cylindrical or other desired shape. As used herein, the walls which touch the holding means instead of the other container (such as walls 12, 14, and 20 in FIG. 1), are referred to as peripheral walls. The walls which touch each other if the containers are placed together as described (such as walls 16 and 18 in FIG. 1) are referred to herein as mated walls, or as non-vertical side walls.

As shown in the figures, the containers of this invention have complementary shapes. This means that as the horizontal dimensions of one container decrease along the vertical axis, the horizontal dimensions of the other container increase in a corresponding manner, so the sum of their horizontal cross-sectional areas remains constant (or nearly constant) at any vertical position between the top and the bottom of the containers. This condition need not apply near the top or bottom of the containers, for two reasons. First, irregularities formed at the beginning or end of a gradient are often discarded as a matter of routine, as the flow stabilizes. Second, the separation zone in most separation processes (such as electrophoresis, IEF, or chromatography) is usually manipulated by choosing proper starting materials and gradient ranges, to keep the desired molecules away from the edges of the gradient.

Each of the containers A and B has a vent at or near the top of the container, to avoid the creation of a vacuum inside the container as it is drained. As used herein, the term "vent" can include an open top, i.e., such as a container with no enclosing wall on the top. If desired, the vents can also serve as inlets, so the containers can be filled with liquid after they are vertically positioned. As shown in FIG. 2, these inlets can be conventional threaded inlets 22 and 24, fitted with caps 26 and 28. Alternately, the containers can be filled through outlet ports 30 and 32 while the containers are held upside down, and the containers can be vented through tubes which pass through fittings 34 and 36. This would allow the use of containers with only one orifice, which would simplify the manufacturing of the containers.

Each container has a fluid outlet adjacent to the bottom, shown in FIG. 2 as outlets 30 and 32. As used herein, "adjacent" includes an outlet through the bottom wall, as shown in the figures, or through a side wall near the bottom. An outlet through the lower part of a side wall can be used to allow the containers to be set directly on a flat surface (such as a laboratory bench or shelf) if desired.

Outlets 30 and 32 are coupled to conduits, such as tubes 40(A) and 42(B), using any suitable means such as conventional threading on outlets 30 and 32 while fittings 34 and 36 have rotatable union joints with gaskets, like the fittings on garden hoses.

Tubes 40(A) and 42(B) are coupled to mixing device 50, using any suitable means. For example, tubes 40(A) and 42(B) can be securely attached to lid 52; lid 52 can be screwed or clamped to mixing vessel 54, then fittings 34 and 36 can be attached to outlets 30 and 32. Alternately, tubes 40(A) and 42(B) can join in a common tube which is attached to mixing device 50. As another alternative configuration, the outlets on the mated containers can be equipped with fittings that screw directly onto the mixing device, if the flow of liquid into the mixing device can be controlled by valve or other means.

To allow an operator to control the drainage of liquids A and B (which have different compositions) into mixing device 50, a valve, clamp, or other flow control device can be fitted on outlet ports 30 and 32, on fittings 34 and 36, on tubes 40(A) and 30(B), or on the inlet of mixing device 50. If desired, the outlet ports, fittings, or tubes can be equipped with check valves which allow only downward flow, to make sure no liquid from one container can enter the other container while a hydrostatic balance is being established.

When the entire system is in operation, mixing device 50 (which can be equipped with a stirrer if desired) is drained via tube 60, which preferably has a valve, adjustable clamp, or other flow control device, or a small internal diameter, to control the outlet flow rate. The gradient mixture of A and B which leaves mixing device 50 can flow to any selected vessel or device, such as (1) a tube, tray, or trough which will be used for electrophoresis or isoelectric focusing; (2) a manifold designed to divide the mixture among numerous devices; or (3) a pump which will add the gradient to a pre-established stream of liquid.

Tubes 40(A) and 42(B) from containers A and B are connected to the mixing device (or to a common tube which enters the mixing device) in such a manner that the two containers can establish hydrostatic equilibrium when the valves (or other flow control devices) are opened. As the containers are drained, the balance in hydrostatic pressure will be maintained through the fluid communication between the two containers. This will cause the fluid levels in both containers to drop at the same rate, assuming that their specific gravities are comparable; if that is not the case in a certain situation, adjustments can be made mathematically or by using floating hydrometers. If their viscosities are markedly different, outlet tubes having different diameters can be provided.

As the fluid levels in containers A and B drop at the same rate (due to hydrostatic equilibrium), the ratio of liquids entering the mixing device at any moment will be equal to the ratio of the surface areas of the liquids in their containers at that moment. For example, if the horizontal area in container A is 9 $cm^2$ and the area in container B is 1 $cm^2$ at a certain height, 90% of the liquid entering the mixing device when the fluid surfaces reach that height will be liquid A. As the fluid levels drop, that ratio changes in a controlled manner depending on the shapes of the containers, thereby creating a gradient in the mixture that passes through the mixing device.

In one preferred embodiment of this invention, shown in FIG. 3, container assembly 10, comprising containers A and B, can be placed in rack 70, which can be made of any suitable material (steel, aluminum, plastic, acrylic, etc.) to hold the containers upright. If the two containers are suitably mated, they will fit together securely in the rack. If desired, a rack or a set of racks can be provided to accommodate a single pair of containers, or multiple pairs if larger volumes of liquid are required. The racks will provide a substantial degree of stability, and the flat sides of the containers will allow them to be set in a stable condition on a bench or shelf when not in use. If desired, the outlets used to drain the containers can have angled or horizontal fittings, to reduce the amount of space required below the containers.

To allow visual monitoring during drainage, the rack can be of open design, it can be made of transparent material such as clear acrylic, or it can be equipped with a transparent window. Calibration marks (such as a 10 by 10 grid, as shown in FIG. 3) can be placed on the rack (along the supports, or across the window) to aid the monitoring process. Alternately, calibration marks can be placed on the walls of the containers.

In an alternate embodiment which avoids the need for a separate rack, the containers of this invention can be provided with holding means such as adhesive tape, rubber bands, mated slots, Velcro, or clamps to hold the containers in proper position. The use of such holding means would allow the containers to be suspended, affixed, or otherwise placed (at equal or nearly equal heights, to allow the establishment of a hydrostatic balance between the containers) on a wall, shelf, equipment stand, or other vertical or elevated surface. This can free up space on a lab bench, and it can make the system less susceptible to being accidentally overturned.

In some configurations of this invention, there is no need for the containers to touch each other. For example, if the containers are affixed to a vertical wall using Velcro, adhesives, clamps, or comparable means, they can be separated.

In an alternate embodiment, the container with the largest area at the bottom can be fitted with legs to give it stability, and the other container can be secured (using adhesive, Velcro, mated slots, or other means) to the stable container.

In another alternate preferred embodiment, a single piece of material can form a side wall of each container. For example, if the containers are manufactured using vacuum molding, two containers with mated shapes can be formed by (1) placing a first layer of plastic over a molding device having a plurality of elevations or depressions; (2) heating or otherwise treating the plastic to make it deformable; (3) causing the plastic to conform to the elevations or depressions in the mold; (4) adhering the molded first sheet to a flat second sheet; and (5) cutting the sheets into sections. Each section will contain two (or more) complementary containers, both of which are attached to the same "backing" sheet. This type of manufacturing process is analogous to the process used to package various small items, which are normally enclosed within clear plastic bubbles attached to cardboard backing cards. The backing cards can be placed on a shelf or suspended from rods, to display the items. In an analogous manner, the "backing" sheet of the mated containers described herein can be stood on a shelf or suspended from any suitable type of holding device, and that backing sheet (which forms a wall of each container) will support the containers of this invention.

Preferably, the outlet tubing for both containers should be as short as practicable and should be approximately the same length. This will enhance reproducibility of the gradients between labs, or within a single lab if the system is disassembled and reassembled. However, if a certain set of tubing is used consistently, it can generate useful and reproducible gradients even if one piece of tubing is longer than the other or has a different internal diameter. If two pieces of tubing have different diameters (for example, to accommodate liquids with different viscosities), it may be preferable to make the thinner tube longer, so their internal volumes will be the same.

Figure 4B:
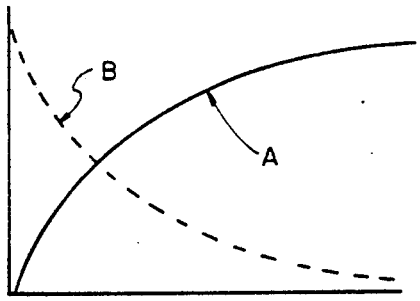
FIG. 4*b* is a graph depicting the gradient that will be formed by the containers shown in FIG. 4*a*.
Figure 5B:
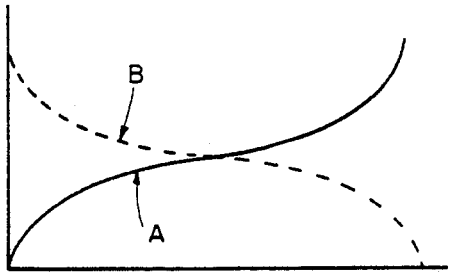
FIG. 5*b* is a graph depicting the gradient that will be formed by the containers shown in FIG. 5*a*.

If the mated walls of the two containers are planar, as shown in FIGS. 1, 2, and 3, the resulting gradient will be linear. In other embodiments of this invention, shown in FIGS. 4*a*, 5*a*, or 6*a*, the mated walls can be curved or otherwise shaped to create non-linear gradients. Depending on the shapes of the containers, gradients can be created which are either convex or concave. The containers shown in FIG. 4*a* will create a gradient as shown in FIG. 4*b*, while the containers shown in FIG. 5*a* will create a more complex curved gradient with a plateau, as shown in FIG. 5*b*. Using properly designed containers (whose mated walls can be sharply angled at one or more locations, as shown in FIG. 6*a*), gradients can be created with one or more plateaus at desired levels, or with steep transitions between adjacent zones.

In an alternate embodiment, more than two containers can be used in this invention. For example, three containers with mated configurations (either planar or curved) can be placed in a single rack or otherwise affixed in vertical position, which will allow three separate liquids to be mixed in a controlled gradient.

If desired, the containers of this invention can be manufactured and sold as kits having various configurations, and a suitable pair can be selected and used to create a gradient having any desired profile. The containers of this invention can also be sold containing buffers and/or monomers that are used in electrophoresis, IEF, chromatography, or other processes.

A further object of the present invention is to provide a liquid mixing device in which the volumes of liquids being mixed can be directly ascertained by reading the calibrations on the containers as the fluid levels drop, providing either absolute or percentage numbers. Such calibration marks can be sufficiently accurate for many uses even in mass-manufactured containers. Furthermore, since the relevant volumes will be read from the bottom upward, complicating factors such as air bubbles will not affect the readings after flow has been properly established and any air bubbles have been bled from the tubing. It should also be pointed out that if any clogging occurs in any of the tubing, it will quickly become apparent from an imbalance in the fluid levels in the containers. This is a substantial advantage over most systems which use pumps.

The containers of this invention can be manufactured from any material which renders them suitable for their specific intended use. For example, most buffers used in biological separation processes, and most monomers used to form gels, will not react with most types of plastic under normal conditions. However, if a liquid is to contain an acid, solvent, or other reagent which can degrade some types of plastic, or if it is to be used at high temperature (either during the gradient forming process or during sterilization), the containers should be made of non-reactive and/or high-temperature plastics, or other material (glass, Pyrex, ceramic, Teflon, stainless steel, etc.) which will not react with the intended liquids under the intended conditions. Similarly, plastics which incorporate plasticizers or other reagents which would leach out of the plastic into certain liquids should be avoided for uses involving those liquids. Numerous types of chemically resistant, non-leaching, and high-temperature plastics are described in any recent edition of the *Modern Plastics Encyclopedia* (published annually by McGraw-Hill, New York, as a special issue of *Modern Plastics* magazine) and in various other publications used by specialists in that field.

For use under most conditions, the containers of this invention can be mass-manufactured very economically. This would make them disposable and eliminate all problems of cleaning, recleaning, and sterilization. Despite their low cost and ease of use, the containers of this invention can be used to create liquid gradients of nearly any desired characteristics, with a high degree of precision and reproducibility.

This invention also involves a method of forming liquid gradients, using the containers of this invention. The typical steps in performing this method would be:

a. filling two separate containers with two differing liquids, wherein each container has a non-vertical side wall and wherein the two containers have complementary shapes, as described above;

b. placing both containers at a level where their fluid levels are at substantially the same elevation;

c. establishing fluid communication between the two containers by means of a fluid receiving device, so that the liquids in both containers establish hydrostatic equilibrium; and d. withdrawing liquid from the receiving device.

This invention also relates to the molds which can be used to mass-manufacture the containers of this invention, using techniques such as blow molding or vacuum molding.

In most types of blow-molding (including extrusion-blow, injection-blow, and stretch-blow molding), a heated and partially shaped plastic "parison" is inserted into a two-part mold and then expanded to fill the mold cavity, using high-pressure air. The mold is then opened, and the shaped plastic device is removed. Blow molding is well-suited for creating containers having threaded inlets or outlets. During the expansion step, the inlet or outlet of the container is formed around the blow-pin. The containers can be trimmed, labelled, or otherwise finished, and fitted with caps which will make it useful as a container.

Figure 7:
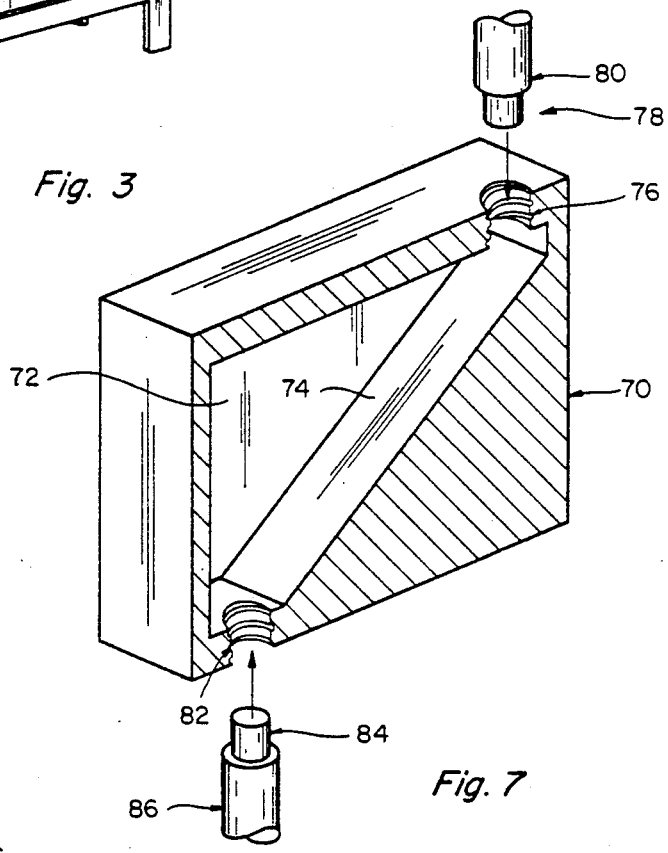
FIG. 7 is a perspective view of part of a mold which can be used to manufacture the containers of this invention.

A mold part useful for creating the containers shown in FIGS. 1 and 2, using blow-molding techniques, is shown in FIG. 7. Mold part 70, made of a metal which can be machine tooled, such as aluminum, has a recessed area 72. Mold part 70 is paired with a complementary part (not shown) which also has a recessed area, to form an internal cavity which will form the outside of a container formed during a blow-molding process.

Recessed area 72 is bounded by angled wall 74, which will create a non-vertical side wall in containers formed in that mold. Alternately, angled wall 72 can be curved or otherwise contoured to create the containers shown in FIGS. 4*a*, 5*a*, and 6*a*.

Mold part 70 contains recessed area 76, which will create an externally-threaded orifice adjacent to one end of the container. During the blow-molding process, blow pin 78 (which has enlarged shoulder 80, which fits securely against mold part 70) is placed within recessed area 76. Air passes through blow pin 78 to cause the plastic parison to expand and fill the cavity.

Mold part 70 also contains a second recessed area 82, which will create a second externally-threaded orifice adjacent to the opposite end of the container. When one orifice is being used as the liquid outlet at the bottom of the container, the opposite orifice can be used as the liquid inlet and as the air vent. During the blow-molding process, retractable pin 84 (which has enlarged shoulder 86) can be inserted into recessed area 82, to create a completed and open orifice. Alternately, the blowing process can create a closed protrusion, which can be opened by reaming or other trimming steps, to avoid the need for a second retractable pin during the molding process.

Figure 8:
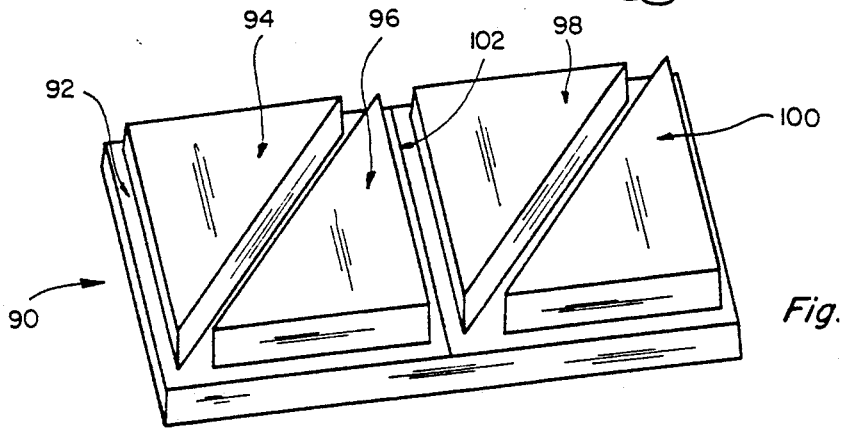
FIG. 8 is a perspective view of a mold array suitable for use in a vacuum molding process to create containers of this invention.

A mold array 90 which is useful for vacuum molding is shown in FIG. 8. In general, vacuum molding involves placing a single sheet of plastic over an array which contains numerous shaped depressions or elevations, each of which serves as a mold to form a single container. For example, an array can have 100 depressions or elevations, to form 100 containers (or to form 50 sets of matched pairs). The array 90 shown in FIG. 8 could be used to create four independent containers, or to create two sets of matched pairs.

Typically, the molding process is performed using steps such as the following: (1) a first layer of plastic is placed over molding array 90; (2) the plastic is heated or otherwise treated to make it deformable; (3) using vacuum or pressure, the flexible layer is pressed against elevations 94 through 100 in mold array 90; (4) the shaped plastic layer is allowed to harden, then it is removed from the array; (5) a second sheet of plastic or other suitable material such as plastic-coated cardboard, which normally is flat, is pressed against and attached to the molded first sheet, using an adhesive or other suitable means; and (6) the assembled sheets are cut into sections. Each section can contain one container if desired; alternately, if the containers are divided along line 102 as shown on mold array 90, each section would contain two complementary containers which share a single backing layer.

If desired, the containers can be filled with inert fluids during or after the manufacturing process (such as after the molded shapes are formed, before the second layer is attached to the first layer). An outlet can be created by puncturing a container near the bottom with a hollow needle attached to a tube, and a vent can be created at the top by simply puncturing the container.

Since numerous molded pieces are created in each suction step, vacuum molding tends to be less expensive (on a per container basis) than blow molding. Since the walls of vacuum molded containers are usually thinner than the walls of blow molded containers, vacuum molding tends to be less well suited for large containers than blow molding.

Either blow molding or vacuum molding can be used to create any number of containers at fairly low cost (many companies which own the necessary equipment will do it on a contract basis), and either process can be used with various plastics having different chemical characteristics. The machinery and techniques used for blow molding, vacuum molding, and other methods of shaping plastic are described in *Modern Plastics Encyclopedia* and other references used by those skilled in that art.

If two mated containers having identical dimensions are inverted to make them complementary (as shown in FIGS. 1, 2, 3, 5*a*, and 6*a*), both containers can be made from a single mold. In other cases, such as shown in FIG. 4*a*, the containers will need to be made from different molds, referred to herein as complementary molds, since the containers they produce will be complementary as that term is defined above.

Numerous equivalents to the specific embodiments described herein can be determined by those skilled in the art, using routine experimentation. Such equivalents are within the scope of the claims.

I claim:

1. A device for combining the liquid outputs of at least two containers in a predetermined gradient-forming manner, comprising:

a. first and second separable containers, each having a closed side wall defining a chamber therein for containing a liquid and vent means to prevent the creation of a vacuum therein as the container drains, the side wall on the first and second containers each including a wall portion which is substantially vertical when liquids are being drained from the first and second containers, and a wall portion having a predetermined contour at least a portion of which is non-vertical, the non-vertical side wall portion of the first container having a shape complementary to the contour of the non-vertical wall portion of the second container;

b. outlet conduit means for draining liquids from the first and second containers into a shared receiving device;

c. a receiving device that is in fluid communication with the outlet conduit means of the first and second containers in a manner which maintains hydrostatic equilibrium between the liquids in the first and second containers while the liquids are draining from said containers into the receiving device.

2. The device of claim 1, wherein the first and second containers are held together in surface-to-surface engagement by holding and supporting means.

3. The device of claim 2, wherein the holding and supporting means includes a rack having means engageable with each of said containers.

4. The device of claim 1, wherein the non-vertical side wall portion of each container is formed by molding a first sheet of plastic which is deformable, and wherein a portion of the side wall of each container is formed by a second sheet of material which is affixed to the first sheet after said first sheet has been molded.

5. The device of claim 1, wherein the receiving device comprises a mixing chamber.

6. The device of claim 1, wherein the receiving device comprises a tube.

7. A device comprising at least two separable containers, each designed to hold a liquid and each having:

a. a bottom portion adjoined to an closed side wall in a manner capable of holding liquid, at least one portion of the side wall of each container being a non-vertical side wall portion;

b. a liquid outlet adjacent to the bottom of each of the containers; and, c. a top portion which includes vent means to prevent the creation of a vacuum therein as the container drains;

wherein the containers are complementary in shape such that when liquids having differing compositions are simultaneously drained from the respective containers into a common receiving device in a manner which sustains hydrostatic equilibrium in the containers, the liquids will drain in a predetermined relationship determined by the contours of the non-vertical side wall portions, thereby creating a mixture having a desired gradient in the receiving device.

8. The device of claim 7, wherein the containers are held together in surface-to-surface engagement by holding and supporting means.

9. The device of claim 7, wherein the holding and supporting means includes a rack having means engageable with each of said containers.

10. The device of claim 7, wherein the non-vertical side wall portion of each container is formed by molding a first sheet of plastic which is deformable, and wherein a portion of the side wall of each container is formed by a second sheet of material which is affixed to the first sheet after said first sheet has been molded.

11. The device of claim 7, additionally including a receiving device which is in fluid communication with the liquid outlet of each container in a manner such that when liquid flow from both containers is established into the receiving device, the liquids in the containers are maintained in hydrostatic equilibrium.

12. The device of claim 11, wherein the receiving device comprises a mixing chamber.

13. The device of claim 11, wherein the receiving device comprises a tube.

14. A device comprising at least two separable containers, each having:

a. a bottom portion adjoined to a side wall in a manner capable of holding liquid, wherein a portion of the side wall is non-vertical;

b. means for draining the container to which it is attached; and, c. means for venting the container to avoid the creation of a vacuum as the container is drained;

wherein the non-vertical portions of the side walls of the containers provide the containers with complementary shapes such that when liquids having different compositions are simultaneously drained from the containers into a receiving device which maintains hydrostatic equilibrium between the containers, the liquids will form a mixture in the receiving device having a desired gradient which depends upon the complementary shapes of the containers.

15. The device of claim 14, wherein the containers are held together by holding means so that the non-vertical portion of the side wall of each container is in surface-to-surface contact with the non-vertical portion of the side wall of the other container.

16. The device of claim 15, wherein the holding means comprises a rack having interior dimensions which cause it to securely hold the containers when the containers are placed together in a manner such that the non-vertical portions of the side walls of the containers are in surface-to-surface contact.

17. The device of claim 14, wherein the non-vertical side wall portion of each container is formed by molding a first sheet of plastic which is deformable, and wherein a portion of the side wall of each container is formed by a second sheet of material which is affixed to the first sheet after said first sheet has been molded.

18. The device of claim 14, additionally including a receiving device which is in fluid communication with the liquid outlet of each container in a manner such that when liquid flow from both containers is established into the receiving device, the liquids in the containers are maintained in hydrostatic equilibrium.

* * * * *

UNITED STATES PATENT AND TRADEMARK OFFICE

CERTIFICATE OF CORRECTION

PATENT NO. : 5,064,100

DATED : November 12, 1991

INVENTOR(S) : Andrew Murel

It is certified that error appears in the above—identified patent and that said Letters Patent is hereby corrected as shown below:

On the title page: Item [76]:

Correct spelling of the name of the inventor is Andrew Murel.

Signed and Sealed this

Twenty-seventh Day of April, 1993

*Attest:*

MICHAEL K. KIRK

*Attesting Officer*

*Acting Commissioner of Patents and Trademarks*